US008559157B2

(12) United States Patent
Nishida

(10) Patent No.: US 8,559,157 B2
(45) Date of Patent: Oct. 15, 2013

(54) ION GENERATION APPARATUS AND ELECTRIC EQUIPMENT USING THE SAME

(75) Inventor: Hiromu Nishida, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 499 days.

(21) Appl. No.: 12/995,547

(22) PCT Filed: Jul. 8, 2009

(86) PCT No.: PCT/JP2009/062417

§ 371 (c)(1),
(2), (4) Date: Dec. 1, 2010

(87) PCT Pub. No.: WO2010/018724

PCT Pub. Date: Feb. 18, 2010

(65) Prior Publication Data

US 2011/0085276 A1 Apr. 14, 2011

(30) Foreign Application Priority Data

Aug. 11, 2008 (JP) ..... 2008-207177

(51) Int. Cl.
*H01T 23/00* (2006.01)

(52) U.S. Cl.
USPC ..... 361/230

(58) Field of Classification Search
USPC ..... 361/230
See application file for complete search history.

(56) References Cited

U.S. PATENT DOCUMENTS

| | | | | |
|---|---|---|---|---|
| 4,643,745 | A * | 2/1987 | Sakakibara et al. | 96/76 |
| 7,916,445 | B2 * | 3/2011 | Sekoguchi et al. | 361/230 |
| 7,961,451 | B2 * | 6/2011 | Sekoguchi et al. | 361/230 |
| 8,149,561 | B2 * | 4/2012 | Shimanaka | 361/230 |
| 2006/0024218 | A1 | 2/2006 | Park et al. | |
| 2007/0109711 | A1 | 5/2007 | Sekoguchi et al. | |
| 2009/0140164 | A1 | 6/2009 | Sekoguchi et al. | |

FOREIGN PATENT DOCUMENTS

| | | | |
|---|---|---|---|
| JP | 3022085 | U | 3/1996 |
| JP | 3025508 | U | 6/1996 |
| JP | 2004-363088 | A | 12/2004 |
| JP | 2006-40877 | A | 2/2006 |
| JP | 2007-29485 | A | 11/2007 |
| JP | 2007-305321 | A | 11/2007 |
| JP | 2008-91166 | A | 4/2008 |
| JP | 2008-108681 | A | 5/2008 |
| WO | WO 2007/129633 | A1 | 11/2007 |

* cited by examiner

*Primary Examiner* — Stephen W Jackson
(74) *Attorney, Agent, or Firm* — Birch, Stewart, Kolasch & Birch, LLP

(57) ABSTRACT

In an ion generation apparatus, an induction electrode for generating positive ions and an induction electrode for generating negative ions are each formed as an independent part and separately mounted on a substrate. Therefore, even if the substrate is warped with changes in temperature, tip end portions of needle electrodes can be positioned at the centers of through holes in the induction electrodes, respectively, and positive ions and negative ions can be stably generated.

5 Claims, 10 Drawing Sheets

ION GENERATION APPARATUS AND ELECTRIC EQUIPMENT USING THE SAME

TECHNICAL FIELD

The present invention relates to an ion generation apparatus and electric equipment using the same, and particularly to an ion generation apparatus generating positive ions and negative ions, and electric equipment using the same.

BACKGROUND ART

Recently, ion generation apparatuses generating both positive ions and negative ions have been put to practical use. FIG. 13 is a perspective view showing a main portion of a conventional ion generation apparatus. In FIG. 13, the ion generation apparatus includes a substrate 51, an induction electrode 52 mounted on a surface of substrate 51, and two needle electrodes 58 and 59.

Induction electrode 52 is formed of one metal plate. Two through holes 54 and 55 are formed in a flat plate portion 53 of induction electrode 52, and a plurality of support portions 56 are formed at a circumferential portion of flat plate portion 53. A substrate insertion portion 57 having a width smaller than that of support portion 56 is formed at a lower end of each of support portions 56 at both ends of flat plate portion 53, and each substrate insertion portion 57 is inserted into a through hole in substrate 51 and soldered. Each of two needle electrodes 58 and 59 is inserted into a through hole in substrate 51 and soldered. Tip ends of needle electrodes 58 and 59 protrude from the surface of substrate 51, and are placed at the centers of through holes 54 and 55, respectively.

When positive high-voltage pulses and negative high-voltage pulses are applied between needle electrodes 58, 59 and induction electrode 52, respectively, corona discharge occurs at tip end portions of needle electrodes 58 and 59, and positive ions and negative ions are generated at the tip end portions of needle electrodes 58 and 59, respectively. The generated positive ions and negative ions are delivered into a room by an air blower, and surround and decompose molds or viruses floating in the air (see for example Japanese Patent Laying-Open No. 2007-305321 (Patent Document 1)).

DOCUMENT LIST

Patent Document

Patent Document 1: Japanese Patent Laying-Open No. 2007-305321

SUMMARY OF THE INVENTION

Problems To Be Solved By the Invention

However, the conventional ion generation apparatus has a problem that, due to a large difference in thermal expansion coefficient between substrate 51 and induction electrode 52, a difference in length between substrate 51 and induction electrode 52 is caused with changes in temperature, resulting in warpage of substrate 51. When substrate 51 is warped, ion generation performance becomes unstable because positions of the tip ends of needle electrodes 58 and 59 are misaligned from the centers of through holes 54 and 55, respectively, and the warpage is not constant. Accordingly, corona discharge as designed cannot be formed, and thus the amount of generated ions deviates from a rated value.

Therefore, a main object of the present invention is to provide an ion generation apparatus stably generating positive ions and negative ions, and electric equipment using the same.

Means For Solving the Problems

An ion generation apparatus in accordance with the present invention is characterized by including: a first induction electrode having a first hole; a second induction electrode having a second hole; a first needle electrode having a tip end placed at a central portion of the first hole for generating positive ions; a second needle electrode having a tip end placed at a central portion of the second hole for generating negative ions; and a substrate mounted with the first and second induction electrodes and the first and second needle electrodes, the first and second induction electrodes each being formed as an independent part and mounted separately on the substrate.

Preferably, an interval between the tip ends of the first and second needle electrodes is greater than 19 mm.

Preferably, the ion generation apparatus includes a power supply circuit applying a positive pulse voltage to the first needle electrode at substantially regular time intervals and applying a negative pulse voltage to the second needle electrode at substantially regular time intervals.

Preferably, the power supply circuit includes: a first diode having a cathode connected to the first needle electrode; a second diode having an anode connected to the second needle electrode; a boost transformer including a primary winding and a secondary winding, one terminal of the secondary winding being connected to an anode of the first diode and a cathode of the second diode, and the other terminal of the secondary winding being connected to the first and second induction electrodes; a capacitor and a diode thyristor connected in series between terminals of the primary winding; an alternating current (AC) voltage generation circuit driven by a direct current (DC) power supply voltage for generating an AC voltage having a frequency higher than that of a commercial AC voltage; and a third diode rectifying the AC voltage for charging the capacitor.

Further, electric equipment in accordance with the present invention includes the ion generation apparatus described above, and an air blowing portion for delivering positive ions and negative ions generated at the ion generation apparatus.

Effects of the Invention

In the ion generation apparatus in accordance with the present invention, since the first induction electrode for generating positive ions and the second induction electrode for generating negative ions are each formed as an independent part and separately mounted on the substrate, the substrate is not warped with changes in temperature. Therefore, even with changes in temperature, tip end portions of the needle electrodes can be positioned at the centers of the holes in the induction electrodes, respectively, and positive ions and negative ions can be stably generated.

MODES FOR CARRYING OUT THE INVENTION

Figure 1:
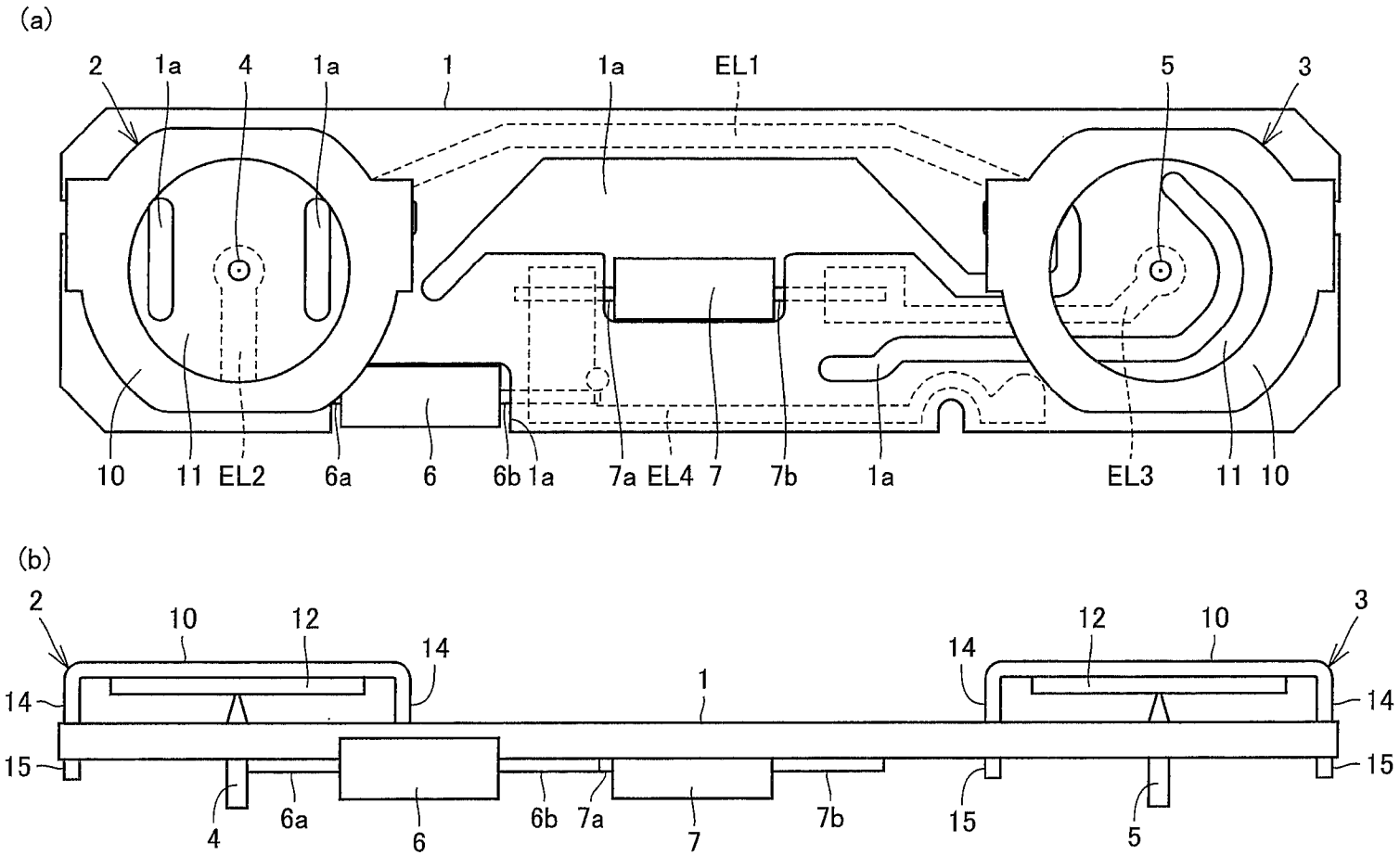
FIG. 1 is a view showing a main portion of an ion generation apparatus in accordance with one embodiment of the present invention.

FIG. 1(*a*) is a plan view showing a main portion of an ion generation apparatus in accordance with one embodiment of the present invention, and FIG. 1(*b*) is a front view thereof. In FIGS. 1(*a*) and 1(*b*), the ion generation apparatus includes a substrate 1, induction electrodes 2 and 3, needle electrodes 4 and 5, and diodes 6 and 7.

Substrate 1 is a rectangular printed substrate. Induction electrodes 2 and 3 are each formed as an independent part, and induction electrode 2 is mounted at one end portion (i.e., the left end portion in the drawing) on a front surface of substrate 1 and induction electrode 3 is mounted at the other end portion (i.e., the right end portion in the drawing) on the front surface of substrate 1.

Figure 2:
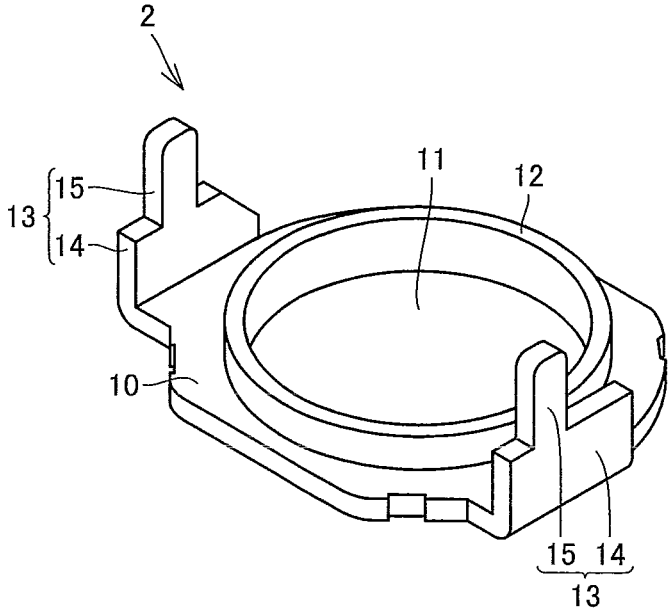
FIG. 2 is a perspective view showing a configuration of an induction electrode shown in FIG. 1.

FIG. 2 is a perspective view of induction electrode 2 seen from below. In FIG. 2, induction electrode 2 is formed of one metal plate. A circular through hole 11 is formed at the center of a flat plate portion 10 of induction electrode 2. Through hole 11 has a diameter of for example, 9 mm. Through hole 11 serves as an opening for emitting ions generated by corona discharge to the outside. A circumferential portion of through hole 11 is formed as a bent portion 12 that is formed by bending the metal plate from flat plate portion 10 using a method such as drawing. By the presence of bent portion 12, the circumferential portion of through hole 11 has a thickness (for example, 1.6 mm) greater than a thickness of flat plate portion 10 (for example, 0.6 mm).

In addition, a leg portion 13 formed by bending a portion of the metal plate from flat plate portion 10 is provided at each of both end portions of flat plate portion 10. Leg portion 13 includes a support portion 14 on a base end side and a substrate insertion portion 15 on a tip end side. When seen from a front surface of flat plate portion 10, support portion 14 has a height (for example, 2.6 mm) greater than the thickness of the circumferential portion of through hole 11 (for example, 1.6 mm). Substrate insertion portion 15 has a width (for example, 1.2 mm) smaller than a width of support portion 14 (for example, 4.5 mm).

Turning back to FIGS. 1(*a*) and 1(*b*), two substrate insertion portions 15 of induction electrode 2 are inserted into two through holes (not shown) formed in one end portion of substrate 1. The two through holes are arranged in a length direction of substrate 1. A tip end portion of each substrate insertion portion 15 is soldered to an electrode on a back surface of substrate 1. A lower end surface of support portion 14 abuts on the front surface of substrate 1. Therefore, flat plate portion 10 is placed parallel to the front surface of substrate 1 with a prescribed gap left therebetween.

Induction electrode 3 has the same configuration as induction electrode 2. Two substrate insertion portions 15 of induction electrode 3 are inserted into two through holes (not shown) formed in the other end portion of substrate 1. The two through holes are arranged in the length direction of substrate 1. The tip end portion of each substrate insertion portion 15 is soldered to an electrode on the back surface of substrate 1. The lower end surface of support portion 14 abuts on the front surface of substrate 1. Therefore, flat plate portion 10 is placed parallel to the front surface of substrate 1 with a prescribed gap left therebetween.

A total of four substrate insertion portions 15 of induction electrodes 2 and 3 are arranged in the length direction of substrate 1. Two substrate insertion portions 15 arranged at a central portion of substrate 1 are electrically connected with each other by an electrode EL1 on the back surface of substrate 1.

As shown in FIGS. 1(*a*) and 1(*b*), induction electrodes 2 and 3 are required not to extend beyond the contour of substrate 1 after being mounted, and dimensions of induction electrodes 2 and 3 are limited to be less than or equal to the width of substrate 1 and less than or equal to half the length of substrate 1. In addition, to minimize the shape as a part and achieve lower cost and improved productivity, vertical and horizontal dimensions of induction electrodes 2 and 3 are set to be substantially identical.

Further, a through hole (not shown) through which the center line of through hole 11 in induction electrode 2 passes is formed in substrate 1, and needle electrode 4 is inserted into the through hole. Needle electrode 4 is provided to generate positive ions. A tip end of needle electrode 4 protrudes from the front surface of substrate 1, a base end thereof protrudes from the back surface of substrate 1, and a central portion thereof is soldered to an electrode EL2 formed on the back surface of substrate 1. When seen from the front surface of substrate 1, the tip end of needle electrode 4 has a height that is set within a range between the height of a lower end and the height of an upper end of bent portion 12 of induction electrode 2 (for example, an intermediate height between the heights of the lower end and the upper end).

Furthermore, a through hole (not shown) through which the center line of through hole 11 in induction electrode 3 passes is formed in substrate 1, and needle electrode 5 is inserted into the through hole. Needle electrode 5 is provided to generate negative ions. A tip end of needle electrode 5 protrudes from the front surface of substrate 1, a base end thereof protrudes from the back surface of substrate 1, and a central portion thereof is soldered to an electrode EL3 formed on the back surface of substrate 1. When seen from the front surface of substrate 1, the tip end of needle electrode 5 has a height that is set within a range between the height of a lower end and the height of an upper end of bent portion 12 of induction electrode 3 (for example, an intermediate height between the heights of the lower end and the upper end). An interval between the tip ends of needle electrodes 4 and 5 is set to a prescribed value.

An anode terminal wire 6*a* of diode 6 is soldered to electrode EL2, and electrically connected to needle electrode 4. A cathode terminal wire 6*b* of diode 6 is soldered to an electrode EL4 on the back surface of substrate 1. An anode terminal wire 7a of diode 7 is soldered to electrode EL4, and electrically connected to cathode terminal wire 6b of diode 6. A cathode terminal wire 7b of diode 7 is soldered to electrode EL3, and electrically connected to needle electrode 5.

At a plurality of locations in substrate 1, cutout portions 1a are formed for receiving main body portions of diodes 6 and 7 or separating electrodes EL2 to EL4 applied with a high voltage from electrode EL1 applied with a reference voltage. Cutout portion 1a is filled with mold resin.

Figure 3:
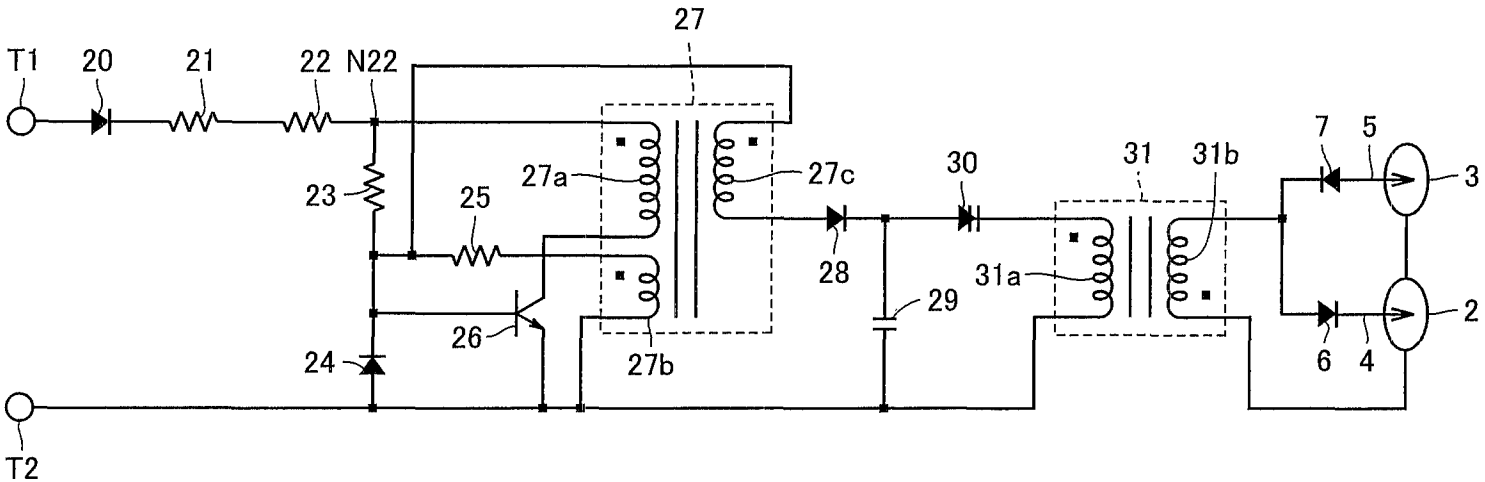
FIG. 3 is a circuit diagram showing an overall configuration of the ion generation apparatus including the main portion shown in FIG. 1.

FIG. 3 is a circuit diagram showing a configuration of a power supply circuit supplying a drive voltage to substrate 1 shown in FIGS. 1(a) and 1(b). In FIG. 3, the power supply circuit includes a power supply terminal T1, a ground terminal T2, diodes 20, 24, and 28, resistance elements 21 to 23 and 25, an NPN bipolar transistor 26, boost transformers 27 and 31, a capacitor 29, and a diode thyristor 30.

A positive terminal and a negative terminal of a DC power supply are connected to power supply terminal T1 and ground terminal T2, respectively. A DC power supply voltage (for example, +12V or +15V) is applied to power supply terminal T1, and ground terminal T2 is grounded. Diode 20 and resistance elements 21 to 23 are connected in series between power supply terminal T1 and a base of transistor 26. An emitter of transistor 26 is connected to ground terminal T2. Diode 24 is connected between ground terminal T2 and the base of transistor 26.

Diode 20 serves as an element for protecting the DC power supply by blocking a current when the positive terminal and the negative terminal of the DC power supply are reversely connected to terminals T1 and T2. Resistance elements 21 and 22 serve as elements for limiting a boost operation. Resistance element 23 is a starting resistance element. Diode 24 operates as a reverse voltage protection element for transistor 26.

Boost transformer 27 includes a primary winding 27a, a base winding 27b, and a secondary winding 27c. Primary winding 27a has one terminal connected to a node N22 between resistance elements 22 and 23, and the other terminal connected to a collector of transistor 26. Base winding 27b has one terminal connected to the base of transistor 26 via resistance element 25. Secondary winding 27c has one terminal connected to the base of transistor 26, and the other terminal connected to ground terminal T2 via diode 28 and capacitor 29.

Boost transformer 31 includes a primary winding 31a and a secondary winding 31b. Diode thyristor 30 is connected between a cathode of diode 28 and one terminal of primary winding 31a. The other terminal of primary winding 31a is connected to ground terminal T2. Secondary winding 31b has one terminal connected to induction electrodes 2 and 3, and the other terminal connected to an anode of diode 6 and a cathode of diode 7. A cathode of diode 6 is connected to needle electrode 4, and an anode of diode 7 is connected to needle electrode 5.

Resistance element 25 serves as an element for limiting a base current. Diode thyristor 30 is an element that becomes conductive when a voltage across terminals reaches a breakover voltage, and becomes nonconductive when a current is reduced to a minimum holding current or less.

Next, an operation of the ion generation apparatus will be described. Capacitor 29 is charged by an operation of an RCC-type switching power supply. Specifically, when the DC power supply voltage is applied across power supply terminal T1 and ground terminal T2, a current flows from power supply terminal T1 to the base of transistor 26 via diode 20 and resistance elements 21 to 23, and transistor 26 becomes conductive. Thereby, a current flows to primary winding 27a of boost transformer 27, and a voltage is generated across terminals of base winding 27b.

The winding direction of base winding 27b is set to further increase a base voltage of transistor 26 when transistor 26 becomes conductive. Therefore, the voltage generated across the terminals of base winding 27b reduces a conductive resistance value of transistor 26 in a positive feedback state. The winding direction of secondary winding 27c is set such that diode 28 blocks energization on this occasion, and no current flows to secondary winding 27c.

As the current flowing to primary winding 27a and transistor 26 continues to increase in this manner, a collector voltage of transistor 26 is increased beyond a saturation region. Thereby, a voltage across the terminals of primary winding 27a is reduced, the voltage across the terminals of base winding 27b is also reduced, and thus the collector voltage of transistor 26 is further increased. Accordingly, transistor 26 operates in the positive feedback state, and transistor 26 immediately becomes nonconductive. On this occasion, secondary winding 27c generates a voltage in a conducting direction of diode 28. Thereby, capacitor 29 is charged.

When a voltage across terminals of capacitor 29 is increased to reach the breakover voltage of diode thyristor 30, diode thyristor 30 operates like a Zener diode and further passes a current. When the current flowing to diode thyristor 30 reaches a breakover current, diode thyristor 30 is substantially short-circuited, and an electric charge charged in capacitor 29 is discharged via diode thyristor 30 and primary winding 31a of boost transformer 31, generating an impulse voltage in primary winding 31a.

When the impulse voltage is generated in primary winding 31a, positive and negative high-voltage pulses are alternately generated in an attenuating manner in secondary winding 31b. The positive high-voltage pulses are applied to needle electrode 4 via diode 6, and the negative high-voltage pulses are applied to needle electrode 5 via diode 7. Thereby, corona discharge occurs at the tip ends of needle electrodes 4 and 5, and positive ions and negative ions are generated, respectively.

On the other hand, when a current flows to secondary winding 27c of boost transformer 27, the voltage across the terminals of primary winding 27a is increased and transistor 26 becomes conductive again, and the operation described above is repeated. The speed of repeating the operation is increased with an increase in the current flowing to the base of transistor 26. Therefore, by adjusting a resistance value of resistance element 21, the current flowing to the base of transistor 26 can be adjusted, and thus the number of discharges by needle electrodes 4 and 5 can be adjusted.

Here, positive ions are cluster ions formed in such a manner that a plurality of water molecules surround a hydrogen ion ($H^+$), and expressed as $H^+(H_2O)_m$ is any natural number). In addition, negative ions are cluster ions formed in such a manner that a plurality of water molecules surround an oxygen ion ($O_2^-$), and expressed as $O_2^-$ $(H_2O)_n$ (n is any natural number). When positive ions and negative ions are emitted into a room, both ions surround molds or viruses floating in the air, and cause a chemical reaction with each other on the surfaces thereof. As a result of action of hydroxyl radicals (.OH) representing active species produced at that time, floating molds or the like are eliminated.

In the present embodiment, since induction electrode 2 for generating positive ions and induction electrode 3 for generating negative ions are each formed as an independent part and separately mounted on substrate 1, substrate 1 is not warped with changes in temperature. Therefore, even with changes in temperature, the tip end portions of needle electrodes 4 and 5 can be positioned at the centers of through holes 11 in induction electrodes 2 and 3, respectively, and positive ions and negative ions can be stably generated.

Concrete Example 1

Figure 4:
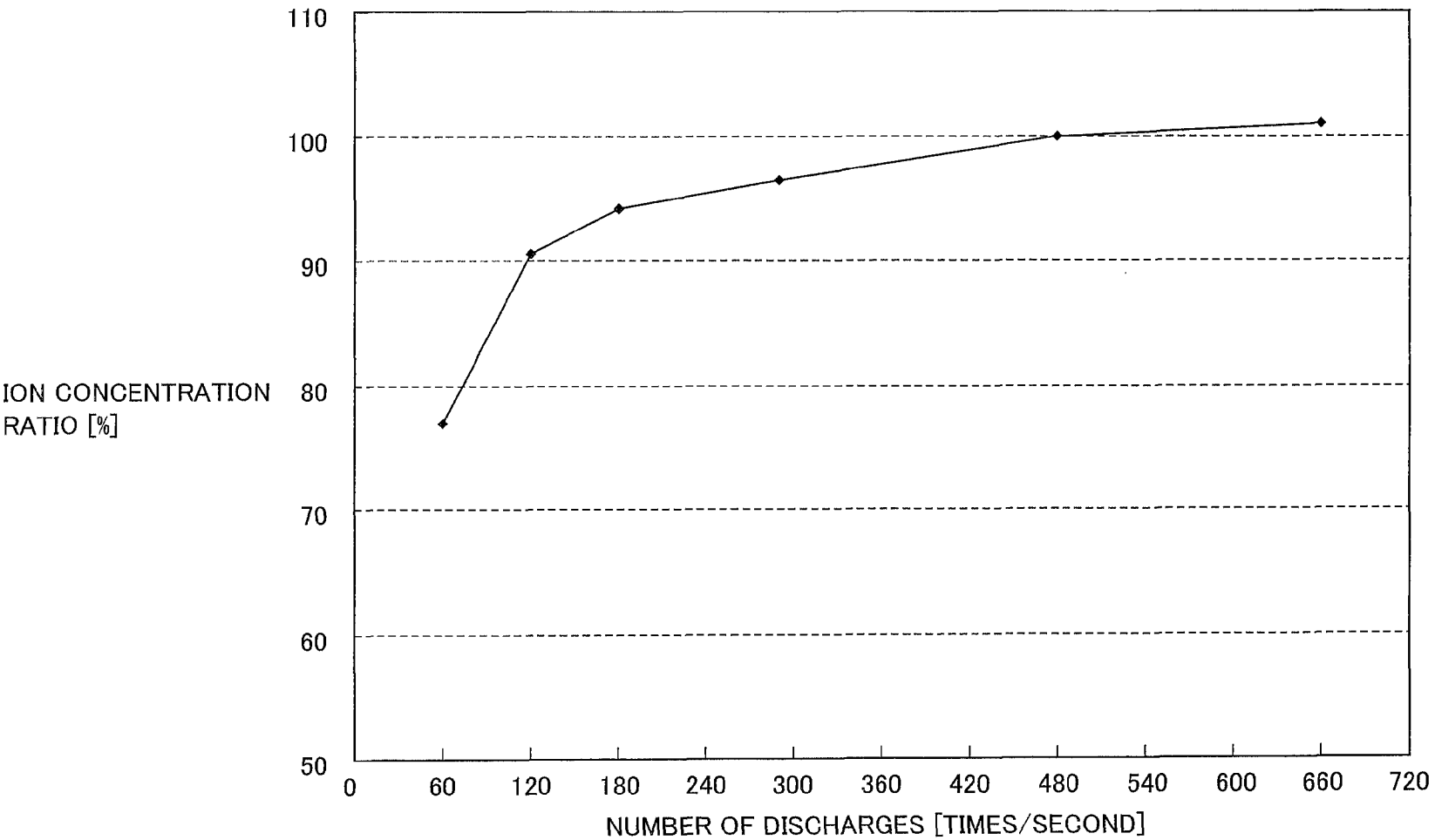
FIG. 4 is a view showing the relationship between the number of discharges and an ion concentration ratio in Concrete Example 1 of the embodiment.

As Concrete Example 1, an ion generation apparatus with an interval between the tip ends of needle electrodes 4 and 5 set to 19 mm was produced. FIG. 4 is a view showing the relationship between the number of discharges (times/second) and an ion concentration ratio (%) in the ion generation apparatus. Here, an ion concentration obtained when the number of discharges was 480 (times/second) was represented as 100%. The number of discharges was changed in a range of 60 to 660 (times/second) by changing the resistance value of resistance element 21 of FIG. 3. The ion generation apparatus was placed in the air with a prescribed wind speed, and the ion concentration was measured using an ion counter placed at a position 25 centimeters downstream of the ion generation apparatus.

In the range of 60 to 480 (times/second), the ion concentration was increased with an increase in the number of discharges. In the range of equal to or greater than 480 (times/second), however, there was only a slight change in the ion concentration even though the number of discharges was increased. This is thought to be because, with an increase in the number of discharges, the amount of generated ions is increased, and the amount of ions eliminated by bonding between positive ions and negative ions is also increased. Since the increase in the number of discharges causes an increase in power consumption, it is preferable to set the number of discharges to around 480 (times/second) in the ion generation apparatus of Concrete Example 1.

Concrete Example 2

Figure 5:
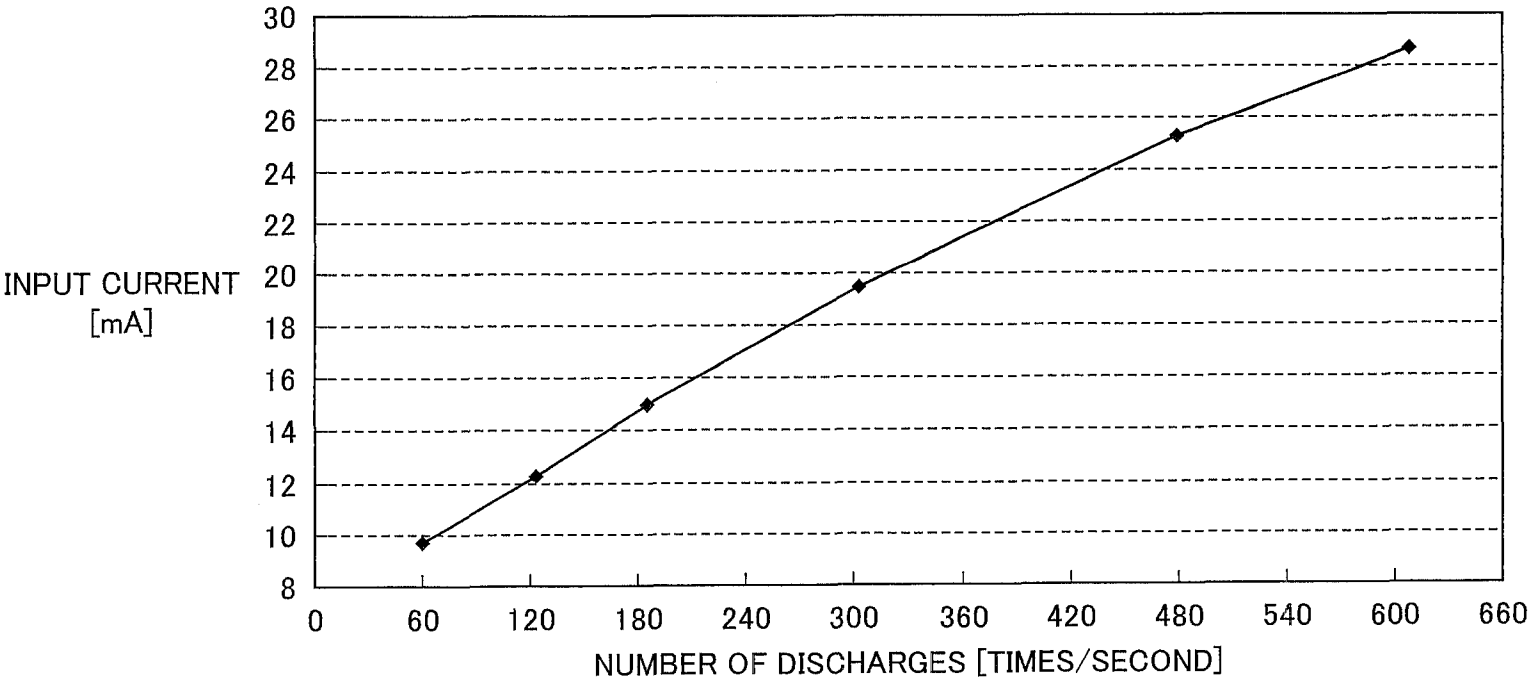
FIG. 5 is a view showing the relationship between the number of discharges and an input current in Concrete Example 2 of the embodiment.

As Concrete Example 2, an ion generation apparatus with an interval between the tip ends of needle electrodes 4 and 5 set to 38 mm was produced. FIG. 5 is a view showing the relationship between the number of discharges (times/second) and an input current (mA) in the ion generation apparatus. The number of discharges was changed in a range of 60 to 600 (times/second) by changing the resistance value of resistance element 21 of FIG. 3. The input current (mA) is a DC current flowing from the DC power supply to power supply terminal T1 of FIG. 3. As can be seen from FIG. 5, the input current was increased substantially in proportion to the number of discharges.

Figure 6:
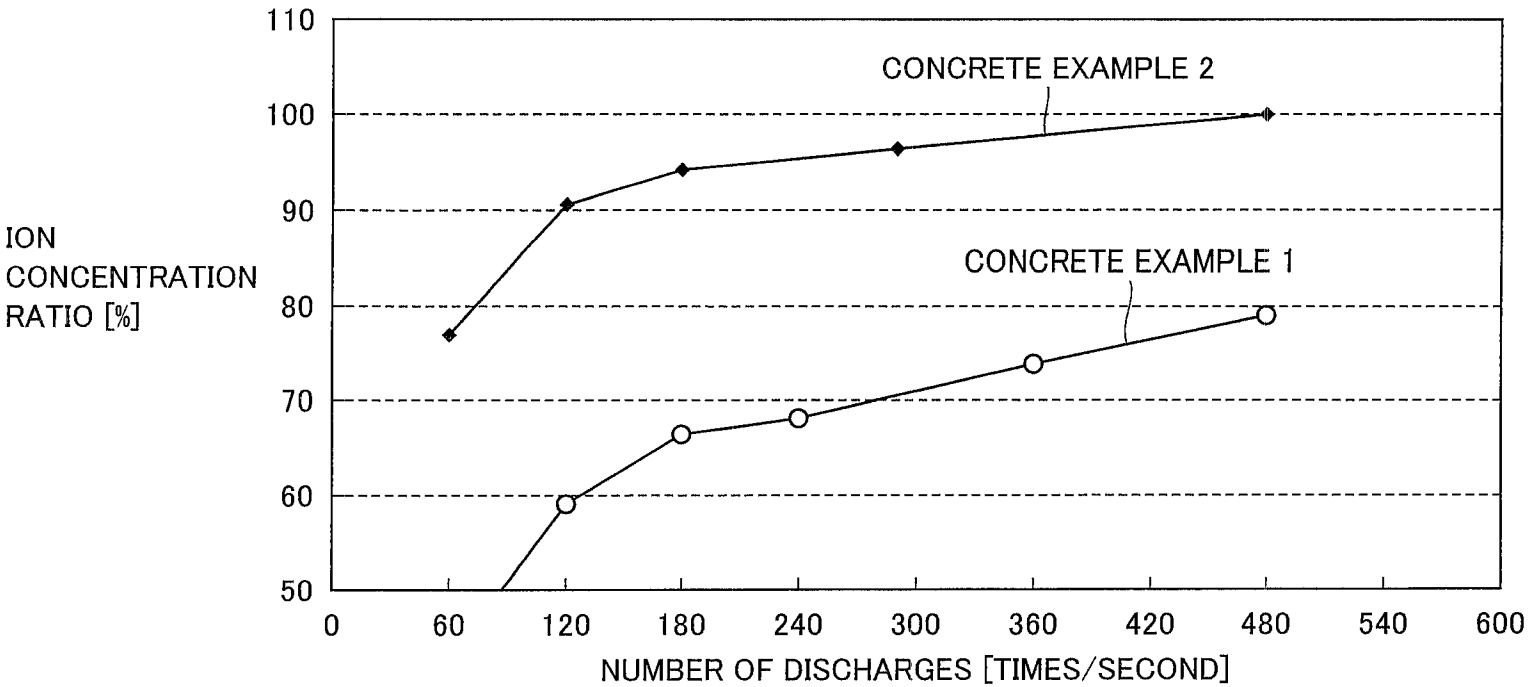
FIG. 6 is a view comparing ion concentrations in Concrete Examples 1 and 2.

FIG. 6 is a view showing the relationship between the number of discharges (times/second) and an ion concentration ratio (%) in each of the ion generation apparatuses of Concrete Examples 1 and 2. Here, an ion concentration (ions/$cm^3$) obtained when the number of discharges in the ion generation apparatus of Concrete Example 2 was 480 (times/second) was represented as 100%. As can be seen from FIG. 6, the ion concentration in Concrete Example 2 is 20% or more higher than the ion concentration in Concrete Example 1. This is thought to be because, as a result of setting the distance between needle electrodes 4 and 5 of Concrete Example 2 to be double that of Concrete Example 1, the amount of ions eliminated by bonding between positive ions and negative ions was decreased.

Accordingly, when compared with the ion generation apparatus of Concrete Example 1, the ion generation apparatus of Concrete Example 2 can generate more ions with less number of discharges (i.e., power consumption). Therefore, it is preferable to set the interval between the tip ends of needle electrodes 4 and 5 to a value greater than 19 mm.

Comparative Example

Figure 7:
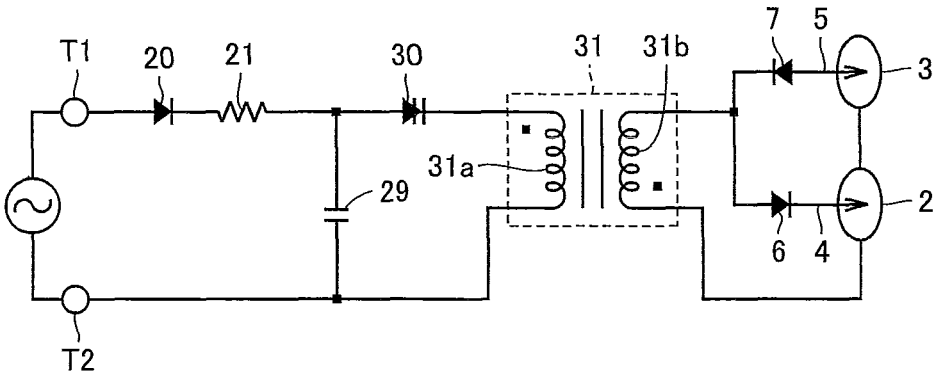
FIG. 7 is a circuit diagram showing a comparative example of the embodiment.

FIG. 7 is a circuit diagram showing a configuration of an ion generation apparatus serving as a comparative example, which is contrasted with FIG. 3. In FIG. 7, the comparative example is different from the embodiment in that resistance elements 22, 23, and 25, diodes 24 and 28, transistor 26, and boost transformer 27 are removed. Diode 20, resistance element 21, and capacitor 29 are connected in series between terminals T1 and T2, and a commercial AC voltage (100 V, 60 Hz) is applied across terminals T1 and T2. The interval between the tip ends of needle electrodes 4 and 5 was set to 19 mm as in Concrete Example 1.

The commercial AC voltage is half-wave rectified by diode 20. Capacitor 29 is charged during a period when the commercial AC voltage has a positive polarity. When the voltage across the terminals of capacitor 29 is increased to reach the breakover voltage of diode thyristor 30, diode thyristor 30 becomes conductive, and the impulse voltage is generated in primary winding 31*a*. Thereby, positive and negative high-voltage pulses are alternately generated in an attenuating manner in secondary winding 31*b*, and positive ions and negative ions are generated at the tip ends of needle electrodes 4 and 5, respectively.

Figure 8:
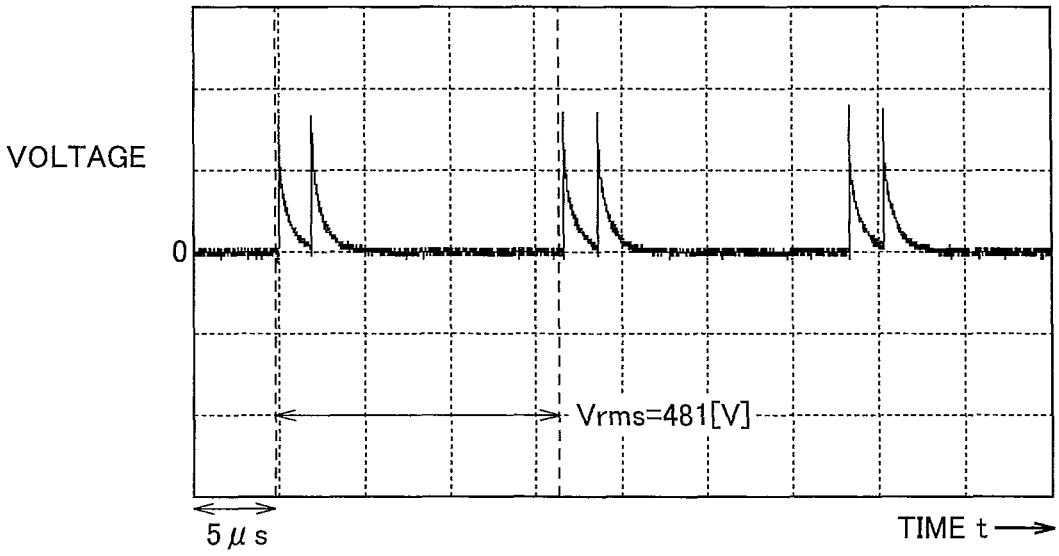
FIG. 8 is a time chart showing a voltage of a needle electrode in the comparative example shown in FIG. 7.

FIG. 8 is a time chart showing a voltage of needle electrode 4. In FIG. 8, two positive high-voltage pulses are successively applied during a period when the commercial AC voltage has a positive polarity, and no high-voltage pulse is applied during a period when the commercial AC voltage has a negative polarity. The number of discharges was 120 (times/second). The voltage applied to needle electrode 4 during one cycle of the commercial AC voltage had an effective value Vrms of 481 (V). Under these conditions, an ion concentration of about 2 million (ions/$cm^3$) was obtained.

Figure 9:
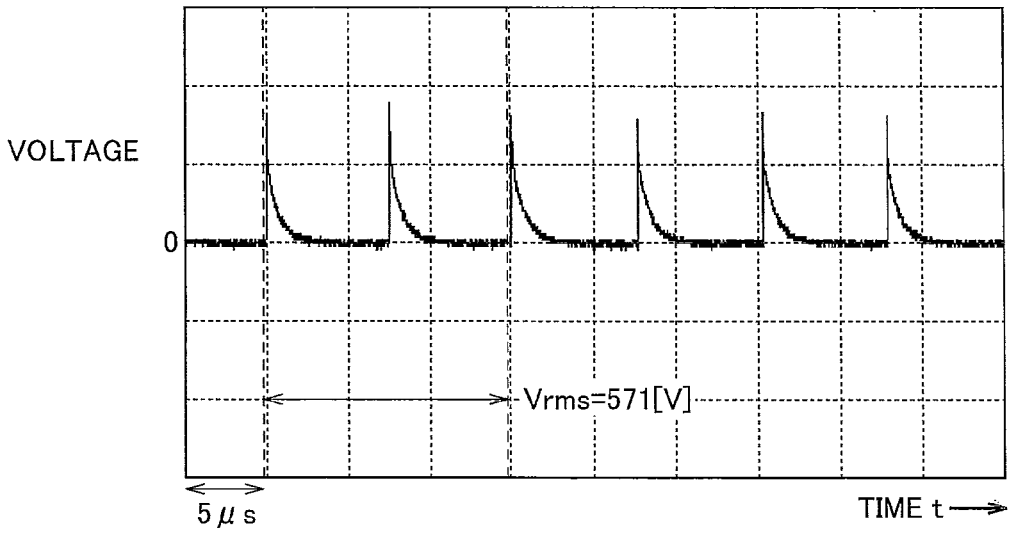
FIG. 9 is a time chart showing a voltage of a needle electrode in Concrete Example 1.

FIG. 9 is a time chart showing a voltage of needle electrode 4 in Concrete Example 1. The number of discharges was set to about 120 (times/second). As can be seen from FIG. 9, positive high-voltage pulses are applied to needle electrode 4 at regular time intervals. This is thought to be because, in the circuit of FIG. 3, an AC voltage having a frequency sufficiently higher than that of the commercial AC voltage is generated in secondary winding 27*c* of boost transformer 27, and as a result, capacitor 29 is charged with a high frequency. Two high-voltage pulses had an effective value Vrms of 571 (V). Under these conditions, an ion concentration of about 2.4 million (ions/$cm^3$) was obtained, which was 1.2 times that of the comparative example.

When two high-voltage pulses are successively applied at a short interval as shown in FIG. 8, it is thought that bonding between positive ions and negative ions is increased as in the case where the number of discharges is increased, and thus the ion concentration is decreased. In contrast, when high-voltage pulses are applied at regular time intervals as shown in FIG. 9, it is thought that bonding between positive ions and negative ions is decreased as in the case where the number of discharges is decreased, and thus the ion concentration is increased. Therefore, Concrete Example 1 is preferable to the comparative example.

Figure 10:
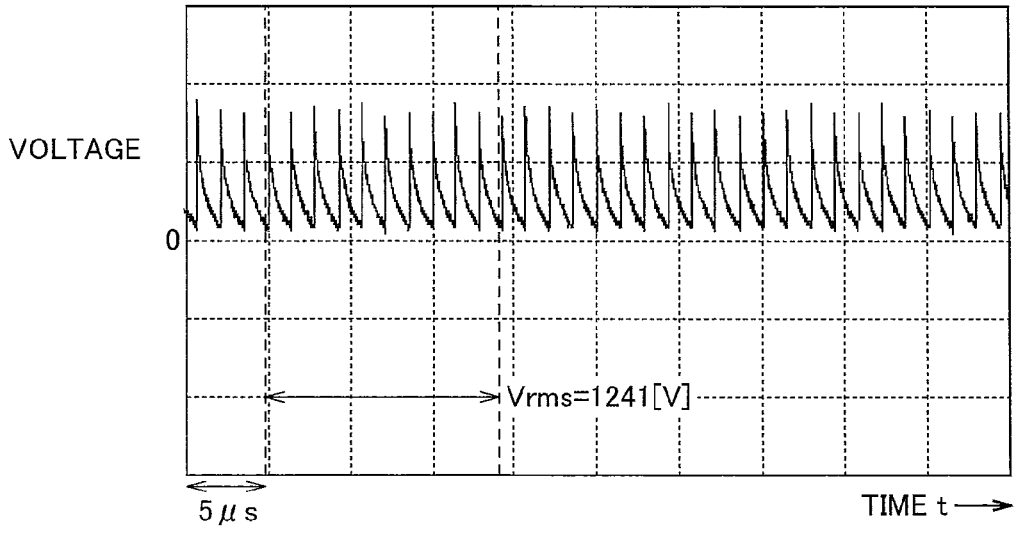
FIG. 10 is a time chart showing a voltage of a needle electrode in Concrete Example 2.

FIG. 10 is a time chart showing a voltage of needle electrode 4 in Concrete Example 2. The number of discharges was set to 460 (times/second). As can be seen from FIG. 10, positive high-voltage pulses are applied to needle electrode 4 at regular time intervals. Ten high-voltage pulses had an effective value Vrms of 1241 (V). Under these conditions, an ion concentration of about 4 million (ions/$cm^3$) was obtained, which was double that of the comparative example.

Applied Example

Figure 11:
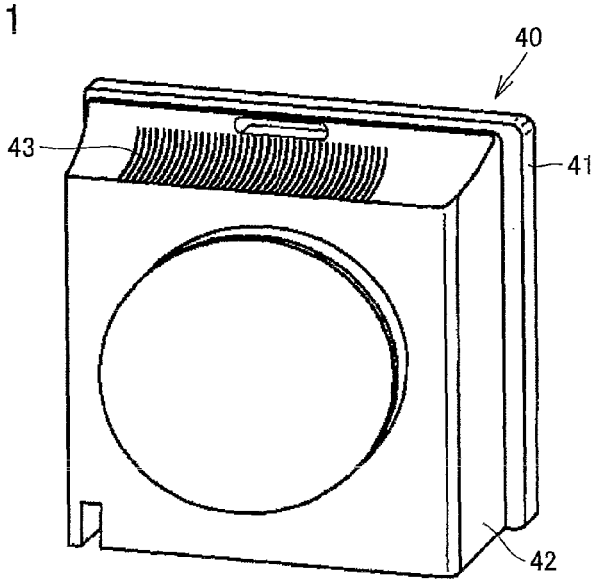
FIG. 11 is a view showing an applied example of the embodiment.
Figure 12:
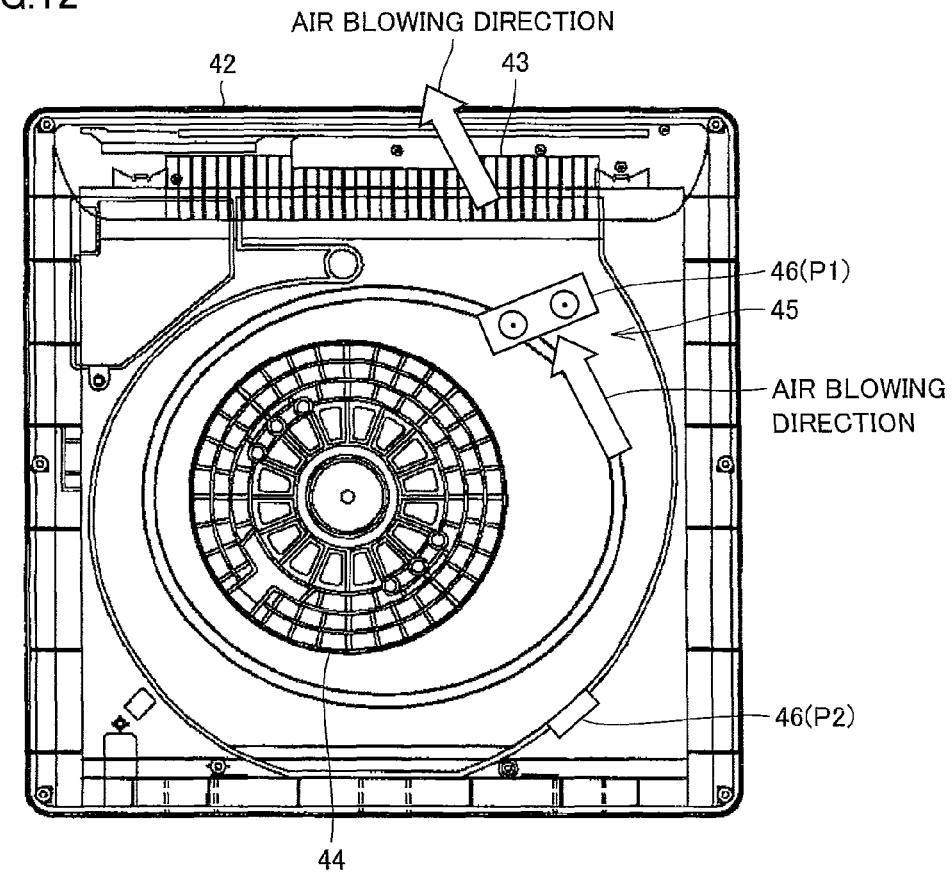
FIG. 12 is a view showing an inside of a main body shown in FIG. 11.
Figure 13:
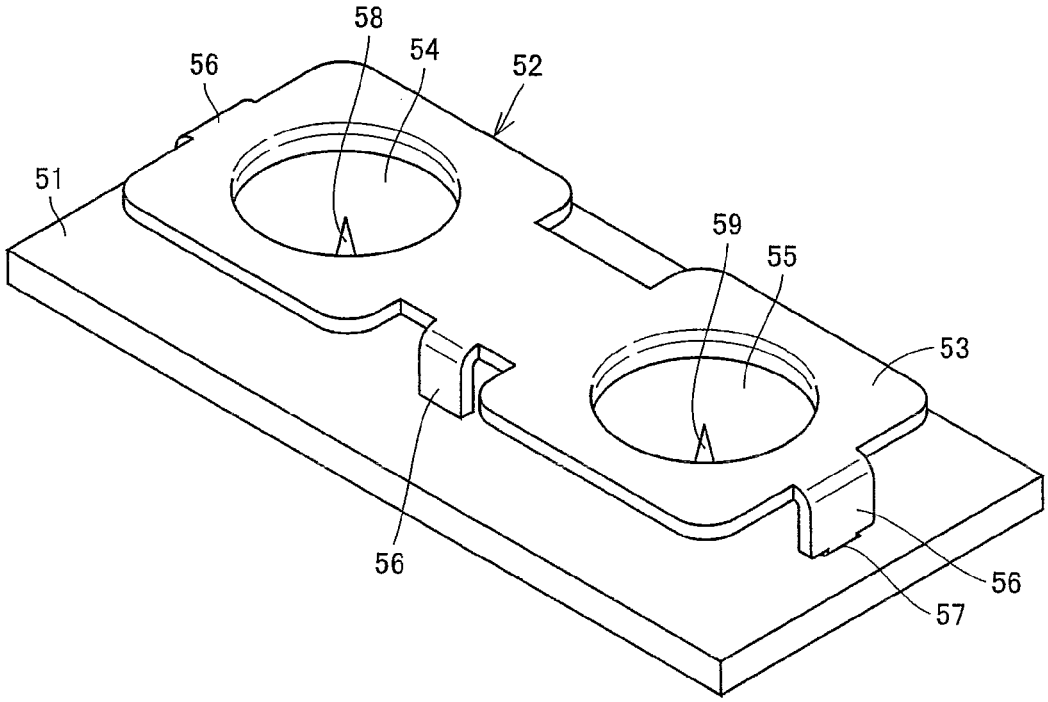
FIG.13 PRIOR ART
FIG. 13 is a view showing a main portion of a conventional ion generation apparatus.

FIG. 11 is a perspective view schematically showing a configuration of an air cleaner 40 including the ion generation apparatus shown in FIGS. 1 to 3. FIG. 12 is an exploded view of air cleaner 40 showing the ion generation apparatus placed in air cleaner 40 shown in FIG. 11.

In FIGS. 11 and 12, air cleaner 40 includes a front panel 41 and a main body 42. An outlet 43 is provided in an upper back portion of main body 42, and purified air containing ions is supplied from outlet 43 into the room. An air inlet 44 is formed at the center of main body 42. Air taken in through air inlet 44 is purified by passing through a filter not shown. The purified air is supplied from outlet 43 through a fan casing 45 to the outside.

An ion generation apparatus 46 shown in FIGS. 1 to 3 is attached to a portion of fan casing 45 forming a passage for the purified air. Ion generation apparatus 46 is placed to be capable of emitting ions generated at needle electrodes 4 and 5 into air flow described above. For example, ion generation apparatus 46 may be placed at a position in the passage for the air, such as a position P1 relatively close to outlet 43 or a position P2 relatively far from the same. By allowing the air to pass through ion generation apparatus 46 as described above, air cleaner 40 can have an ion generation function to supply ions together with the purified air from outlet 43 to the outside.

In addition to air cleaner 40, the ion generation apparatus of the present embodiment can be mounted to an ion generator (a circulator equipped with an ion generation apparatus), an air-conditioner, a refrigerator, a sweeper, a humidifier, a dehumidifier, a washing and drying machine, an electric fan heater, and the like, and can be mounted to any electric equipment having an air blowing portion for sending ions on an air flow.

It should be understood that the embodiment disclosed herein is illustrative and non-restrictive in every respect. The scope of the present invention is defined by the terms of the claims, rather than the description above, and is intended to include any modifications within the scope and meaning equivalent to the terms of the claims.

DESCRIPTION OF THE REFERENCE SIGNS

1, 51: substrate, 1*a*: cutout portion, 2, 3, 52: induction electrode, 4, 5, 58, 59: needle electrode, 6, 7, 20, 24, 28: diode, 6*a*, 7*a*: anode terminal wire, 6*b*, 7*b*: cathode terminal wire, 10, 53: flat plate portion, 11, 54, 55: through hole, 12: bent portion, 13: leg portion, 14, 56: support portion, 15, 57: substrate insertion portion, EL: electrode, T1: power supply terminal, T2: ground terminal, 21 to 23, 25: resistance element, 26: NPN bipolar transistor, 27, 31: boost transformer, 27*a*, 31*a*: primary winding, 27*b*: base winding, 27*c*, 31*b*: secondary winding, 29: capacitor, 30: diode thyristor, 40: air cleaner, 41: front panel, 42: main body, 43: outlet, 44: air inlet, 45: fan casing, 46: ion generation apparatus.

The invention claimed is:

1. An ion generation apparatus, comprising:
- a first induction electrode having a first hole;
- a second induction electrode having a second hole;
- a first needle electrode having a tip end placed at a central portion of said first hole for generating positive ions;
- a second needle electrode having a tip end placed at a central portion of said second hole for generating negative ions; and
- a substrate mounted with said first and second induction electrodes and said first and second needle electrodes,
- said first and second induction electrodes each being formed as an independent part and mounted separately on said substrate.

2. The ion generation apparatus according to claim 1, wherein an interval between the tip ends of said first and second needle electrodes is greater than 19 mm.

3. The ion generation apparatus according to claim 1, comprising a power supply circuit applying a positive pulse voltage to said first needle electrode at substantially regular time intervals and applying a negative pulse voltage to said second needle electrode at substantially regular time intervals.

4. The ion generation apparatus according to claim 3, wherein said power supply circuit includes:
- a first diode having a cathode connected to said first needle electrode;
- a second diode having an anode connected to said second needle electrode;
- a boost transformer including a primary winding and a secondary winding, one terminal of said secondary winding being connected to an anode of said first diode and a cathode of said second diode, and another terminal of said secondary winding being connected to said first and second induction electrodes;
- a capacitor and a diode thyristor connected in series between terminals of said primary winding;
- an AC voltage generation circuit driven by a DC power supply voltage for generating an AC voltage having a frequency higher than that of a commercial AC voltage; and
- a third diode rectifying said AC voltage for charging said capacitor.

5. Electric equipment, comprising:
- the ion generation apparatus according to any of claims 1 to 4; and
- an air blowing portion for delivering positive ions and negative ions generated at said ion generation apparatus.

* * * * *

UNITED STATES PATENT AND TRADEMARK OFFICE

CERTIFICATE OF CORRECTION

PATENT NO. : 8,559,157 B2
APPLICATION NO. : 12/995547
DATED : October 15, 2013
INVENTOR(S) : Hiromu Nishida It is certified that error appears in the above-identified patent and that said Letters Patent is hereby corrected as shown below:

ON THE TITLE PAGE:

At item (56), References Cited, in the listing of Foreign Patent Documents, change:

"JP 2007-29485 A 11/2007" to --JP 2007-294285 A 11/2007--.

Signed and Sealed this
Twentieth Day of May, 2014

Michelle K. Lee

Michelle K. Lee
*Deputy Director of the United States Patent and Trademark Office*